US011148434B2

(12) United States Patent
Walkington et al.

(10) Patent No.: US 11,148,434 B2
(45) Date of Patent: Oct. 19, 2021

(54) CONTINUOUS INKJET PRINTERS

(71) Applicant: Domino UK Limited, Cambridge (GB)

(72) Inventors: Stuart Mark Walkington, St. Albans (GB); Richard Thomas Calhoun Bridges, Trumpington (GB); Colin Jon Partridge, Baldock (GB); Justin Chase, Elsworth (GB)

(73) Assignee: Domino UK Limited

( * ) Notice: Subject to any disclaimer, the term of this patent is extended or adjusted under 35 U.S.C. 154(b) by 322 days.

(21) Appl. No.: 16/300,989

(22) PCT Filed: May 11, 2017

(86) PCT No.: PCT/GB2017/051318
§ 371 (c)(1),
(2) Date: Nov. 13, 2018

(87) PCT Pub. No.: WO2017/194952
PCT Pub. Date: Nov. 16, 2017

(65) Prior Publication Data

US 2020/0316958 A1 Oct. 8, 2020

(30) Foreign Application Priority Data

May 13, 2016 (GB) ..... 1608485

(51) Int. Cl.
*B41J 2/02* (2006.01)
*B41J 2/185* (2006.01)
*B41J 2/17* (2006.01)

(52) U.S. Cl.
CPC ..... *B41J 2/185* (2013.01); *B41J 2/1721* (2013.01); *B41J 2002/1853* (2013.01)

(58) Field of Classification Search
CPC . B41J 2/02; B41J 2002/1853; B41J 2002/022
See application file for complete search history.

(56) References Cited

U.S. PATENT DOCUMENTS

| | | | | |
|---|---|---|---|---|
| 4,360,817 | A | 11/1982 | Arway et al. | |
| 5,701,149 | A * | 12/1997 | Pagnon | B41J 2/18 347/17 |
| 8,888,209 | B2 | 11/2014 | Pouzet | |
| 2009/0040283 | A1 | 2/2009 | Matsuda et al. | |
| 2011/0001771 | A1* | 1/2011 | Heylen | B41J 2/085 347/6 |

FOREIGN PATENT DOCUMENTS

| | | | |
|---|---|---|---|
| CN | 101903181 | A | 12/2010 |
| EP | 0805040 | A2 | 11/1997 |
| EP | 1700700 | A2 | 9/2006 |

(Continued)

OTHER PUBLICATIONS

Fukuda et al., Machine Translation of JP2014-065203, 2014 (Year: 2014).*

(Continued)

*Primary Examiner* — Scott A Richmond
(74) *Attorney, Agent, or Firm* — Price Heneveld LLP

(57) ABSTRACT

The invention discloses various methods of controlling or monitoring the performance of a continuous inkjet printer based on monitoring vacuum levels and/or noise in the gutter line.

3 Claims, 4 Drawing Sheets

(56) References Cited

FOREIGN PATENT DOCUMENTS

| | | | | |
|---|---|---|---|---|
| EP | 2195169 | A1 | | 6/2010 |
| GB | 2250236 | A | | 6/1992 |
| GB | 2479751 | | | 10/2011 |
| JP | S57167270 | A | | 10/1982 |
| JP | 2000-203004 | A | | 7/2000 |
| JP | 2000-229419 | A | | 8/2000 |
| JP | 2004299295 | A | | 10/2004 |
| JP | 2014-065203 | A | | 4/2014 |
| JP | 2014065203 | A | | 4/2014 |
| JP | 2014065203 | A | * | 4/2014 |
| JP | 2015-155165 | A | | 8/2015 |
| WO | 2009081110 | A1 | | 7/2009 |
| WO | 2014156297 | A1 | | 10/2014 |

OTHER PUBLICATIONS

Brennan, Christopher E., "Fundamentals of Multiphase Flow," Dec. 30, 2005.

Brennan, Christopher Earls, "Fundamentals of Multiphase Flow," Cambridge University Press, ISBN 978-0-521-84804-6 2005, pp. 163-195.

* cited by examiner

CONTINUOUS INKJET PRINTERS

FIELD OF THE INVENTION

This invention relates to continuous inkjet printers and, in particular, to a single-jet continuous inkjet printer.

BACKGROUND TO THE INVENTION

Continuous inkjet ('CIJ') printers are widely used to place identification codes on products. Typically a CIJ printer includes a printer housing that contains a system for pressurising ink. Once pressurised, the ink is passed, via an ink feed line through a conduit, to a printhead. At the printhead the pressurised ink is passed through a nozzle to form an ink jet. A vibration or perturbation is applied to the ink jet causing the jet to break into a stream of droplets.

The printer includes a charge electrode to charge selected droplets, and an electrostatic facility to deflect the charged droplets away from their original trajectory and onto a substrate. By controlling the amount of charge that is placed on droplets, the trajectories of those droplets can be controlled to form a printed image.

A continuous inkjet printer is so termed because the printer forms a continuous stream of droplets irrespective of whether or not any particular droplet is to be used to print. The printer selects the drops to be used for printing by applying a charge to those drops, unprinted drops being allowed to continue, on the same trajectory as they are jetted from the nozzle, into a catcher or gutter. The unprinted drops collected in the gutter are returned from the printhead to the printer housing via a gutter line included in the same conduit as contains the pressurised ink feed line feeding ink to the printhead. Ink, together with entrained air, is generally returned to the printer housing under vacuum, the vacuum being generated by a pump in the gutter line.

To achieve reliable operation of a CIJ printer, proper start-up and shut-down routines must be followed. Typical routines for start-up and shut-down are outlined in EP 0 908 316. On shut-down the gutter line of the printer must be cleared of ink to prevent the line from becoming blocked. It will be appreciated that different ink viscosities and different conduit lengths will require different operating routines to ensure that the gutter line is always cleared of ink.

One drawback of CIJ printers is that the process of returning ink and air to the printer housing consumes some of the solvent contained in the ink through evaporation from the ink into the air that is entrained with the ink in the gutter line. Several different methods have been used in an attempt to reduce the amount of solvent consumed. These methods focus on three main approaches: 1) recirculating air to the printhead, 2) using a Peltier device in a vent leading from an ink reservoir in the printer housing, or 3) attempting to reduce the amount of air entrained into the conduit.

EP 0 560 332 discloses a system that reduces solvent consumption by re-circulating the air returned from the conduit back up to the printhead. After a short period of time the air in the printhead becomes saturated and the loss of solvent is minimised. However this method requires a fine balance of airflow so that the ink reservoir tank in the printer housing does not become over-pressured as more air is returned than makes its way back to the printhead.

A similar approach is taken in EP 2 292 433 which describes a problem where solvent-laden air condenses onto the printhead deflection electrodes, causing failure. The outlined solution is to allow part of the air to be vented to atmosphere rather than back to the printhead, and to place the outlet of the re-circulating pipe close to the gutter.

WO 93/17869 discloses the use of a Peltier device in a ventilation outlet from an ink reservoir, the Peltier device condensing volatile organic solvents passing from the reservoir through the vent. However the use of a Peltier device is this situation is problematic in that it condenses water vapour as well as recovering volatile organic compounds from the re-circulated ink and the recovered water is a contaminant for many continuous inkjet inks. U.S. Pat. No. 8,360,564 attempts to resolve the water contamination problem by the use of a two-stage condenser for removing solvent vapour from the reservoir vent. The condenser has a first cold surface at the dew point of water to remove water vapour, and a second cooler surface to remove solvent from the vapour.

As an example of the third approach mentioned above, WO 99/62717 describes a method for reducing solvent consumption by varying, interrupting or pulsing the flow of fluid between the gutter and the suction pump, by use of a valve. This document discloses the surprising result that ink can still be cleared even if the airflow is interrupted. The teaching of this patent is in contrast to the experience of the present applicant.

WO 2009/081110 also describes a system that uses a valve to vary gutter flow depending on environmental conditions. A drawback of any system that has a valve in the gutter line is that the air/ink mixture is likely to dry on the valve making it stick and exhibit unreliability.

In WO 2009/047503 a system having two or more gutter pumps is described. At low temperatures, where viscosity is high, both pumps are engaged; at high temperatures, where viscosity is lower, only one pump is activated.

EP 0 805 040 discloses a multi-jet CIJ printer in which the control of gutter vacuum focuses on establishing a flow regime in the printer that is at a lower vacuum point than a flow regime called slug flow. Slug flow is characterised by the flow of individual slugs of ink and air and causes a high level of pressure noise when measured by a pressure sensor. In this document it is disclosed that the printer is operated at a regime lower than slug flow, termed bubble flow. It contrast to this teaching it is the experience of the present applicant that a CIJ printer cannot be operated reliably in a regime at or below slug flow because it is not possible to keep the gutter cleared of ink. This in turn leads to spillage and damage to the printed substrate.

It is an object of the invention to provide one or more methods involving the observation and/or control of flow through the gutter line of a continuous inkjet printer that will go at least some way in addressing the drawbacks of the systems described above; or which will at least provide a novel and inventive alternative.

SUMMARY OF THE INVENTION

Accordingly the invention provides a method of controlling the flow of ink and/or air through the gutter line of a single jet continuous inkjet printer using a vacuum pump, said method comprising identifying the transition between annular flow and transition flow in said gutter line and controlling said pump to maintain transition flow in said gutter line.

Preferably the step of identifying annular flow and transition flow in said gutter line comprises observing fluctuations in pressure in said gutter line.

Alternatively the step of identifying annular flow and transition flow in said gutter line comprises observing fluctuations in an electrical current driving said pump.

In a second aspect the invention provides a method of determining a blockage in a gutter line of a continuous inkjet printer, said method being characterised in that it includes comparing a vacuum level in said gutter line with a reference operating vacuum.

In a third aspect the invention comprises a method of determining a mis-alignment between a jet of ink droplets and a gutter of a continuous inkjet printer, said method being characterised in that it includes comparing a vacuum level in a gutter line of said printer with a reference operating vacuum.

Preferably said method is effected within a pre-determined time following start-up.

Preferably, in addition, said method is applied during normal operation wherein a sudden fall in vacuum over a defined time period, in said gutter line, is interpreted as mis-alignment between said jet of ink droplets, and said gutter.

In a fourth aspect the invention comprises a method of conducting a shut-down routine in a continuous inkjet printer, said printer having a gutter line leading from a print head to a printer housing said method being characterised in that it includes monitoring the vacuum level in said gutter line and completing said shut-down routine In a fifth aspect the invention provides a method of monitoring the performance of a gutter pump forming part of a continuous inkjet printer, wherein said gutter pump operates to draw ink and/or air through a gutter line in said printer, said method including establishing a characteristic vacuum that should apply in said gutter line, and comparing the vacuum level in said gutter line, with said characteristic vacuum during normal operation.

Preferably said method is effected within a predetermined time following start-up.

In a sixth aspect the invention provides a continuous inkjet printer including a printer housing;

a printhead spaced from said printer housing;

a gutter line configured to return ink from said printhead to said printer housing;

a gutter pump operative to draw ink and/or air through said gutter line; and a pressure sensor configured to measure vacuum levels in said gutter line, said printer further including a control facility operative to:

maintain transition flow through said gutter line; and/or determine a blockage in said gutter line; and/or determine mis-alignment between an ink nozzle and a gutter in said print head; and/or monitor the performance of said gutter pump; and/or undertake a shut-down routine that includes responding to measures of vacuum sensed by said pressure sensor.

Many variations in the way the present invention can be performed will present themselves to those skilled in the art. The description which follows is intended as an illustration only of one means of performing the invention and the lack of description of variants or equivalents should not be regarded as limiting. Wherever possible, a description of a specific element should be deemed to include any and all equivalents thereof whether in existence now or in the future.

BRIEF DESCRIPTION OF THE DRAWINGS

The invention will now be described in more detail and by way of example only with reference to the accompanying drawings in which.

DESCRIPTION OF WORKING EMBODIMENTS

Figure 1:
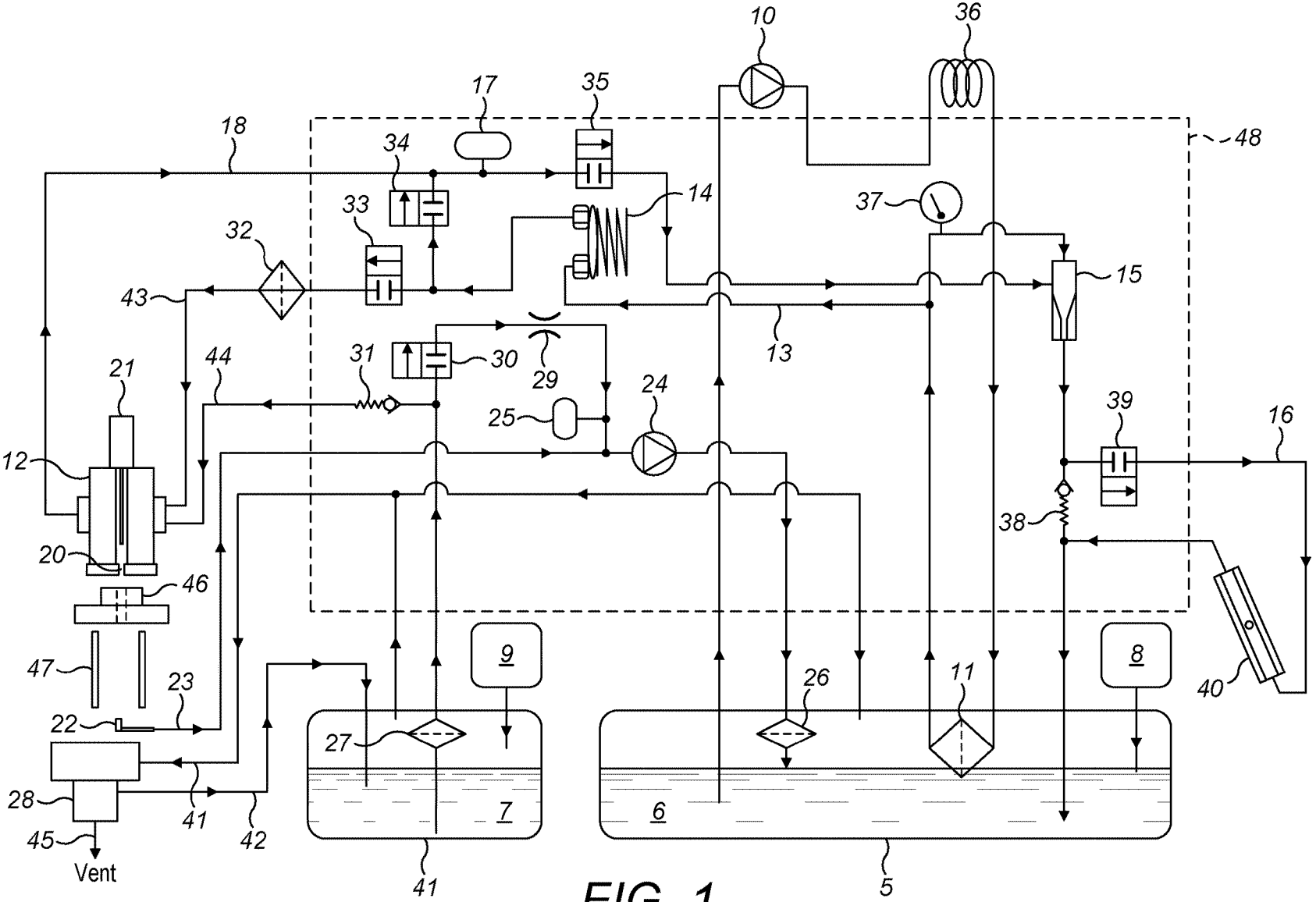
FIG. 1: shows a schematic of an ink circuit of a typical continuous inkjet printer suitable for performing the various aspects of the invention.

Referring to FIG. 1 a continuous inkjet printer, in this case a single-jet continuous inkjet printer, is shown in diagrammatic form, the printer drawing ink from ink reservoir 6 and make-up fluid or solvent from reservoir 7. The reservoirs 6 and 7 are topped-up from cartridges 8 and 9 respectively.

Ink is drawn from the reservoir 6 by feed pump 10. The pump 10 pushes the ink through an ink cooler 36 and then through a fine system filter 11. Ink is then directed either to the drop generator 12, through feed line 13, via a damper 14; or through a jet pump 15 and back to the reservoir 6. The ink flow through the jet pump can also be directed through a viscometer loop 16 to enable the viscosity of the ink to be determined. In stand-by mode, when the printer is not printing, all ink is circulated through the jet pump 15 and back to the reservoir 6. In this state the flow of ink is comparatively high while the pressure is comparatively low.

Restrictors are used to balance the flows between the feed path to the printhead and the circulation path back to the reservoir. The drop generator 12 requires a low flow of the order of 5 ml/min at a high pressure of around 3 bar, whilst the jet pump 15 and viscometer loop 16 require a much higher flow of the order of 800 ml/min at a much lower pressure. The pressure at the drop generator 12 is measured by pressure transducer 17 included in the bleed line 18.

In the conventional manner, ink is jetted through the printhead nozzle 20, upon the release of the nozzle valve 21, and the jet is aligned such that it enters the ink catcher or gutter 22 and is returned to the printer via a gutter line 23. A gutter pump 24 draws a vacuum in the gutter line 23, pressure sensor 25 being attached to the gutter line 23, prior to the gutter pump 24, to monitor the vacuum in the gutter line. The ink and air mixture returned by the gutter pump 24 is directed back into reservoir 6, via a gutter filter 26. The gutter pump is preferably an electrically driven variable speed diaphragm pump.

In accordance with a first aspect of the invention, the noise generated in the gutter line is monitored in order to control the operation of the gutter pump 24. This 'noise' may comprise pressure fluctuations in the gutter line 23 or fluctuations in the electrical current driving the pump 24.

Figure 2:
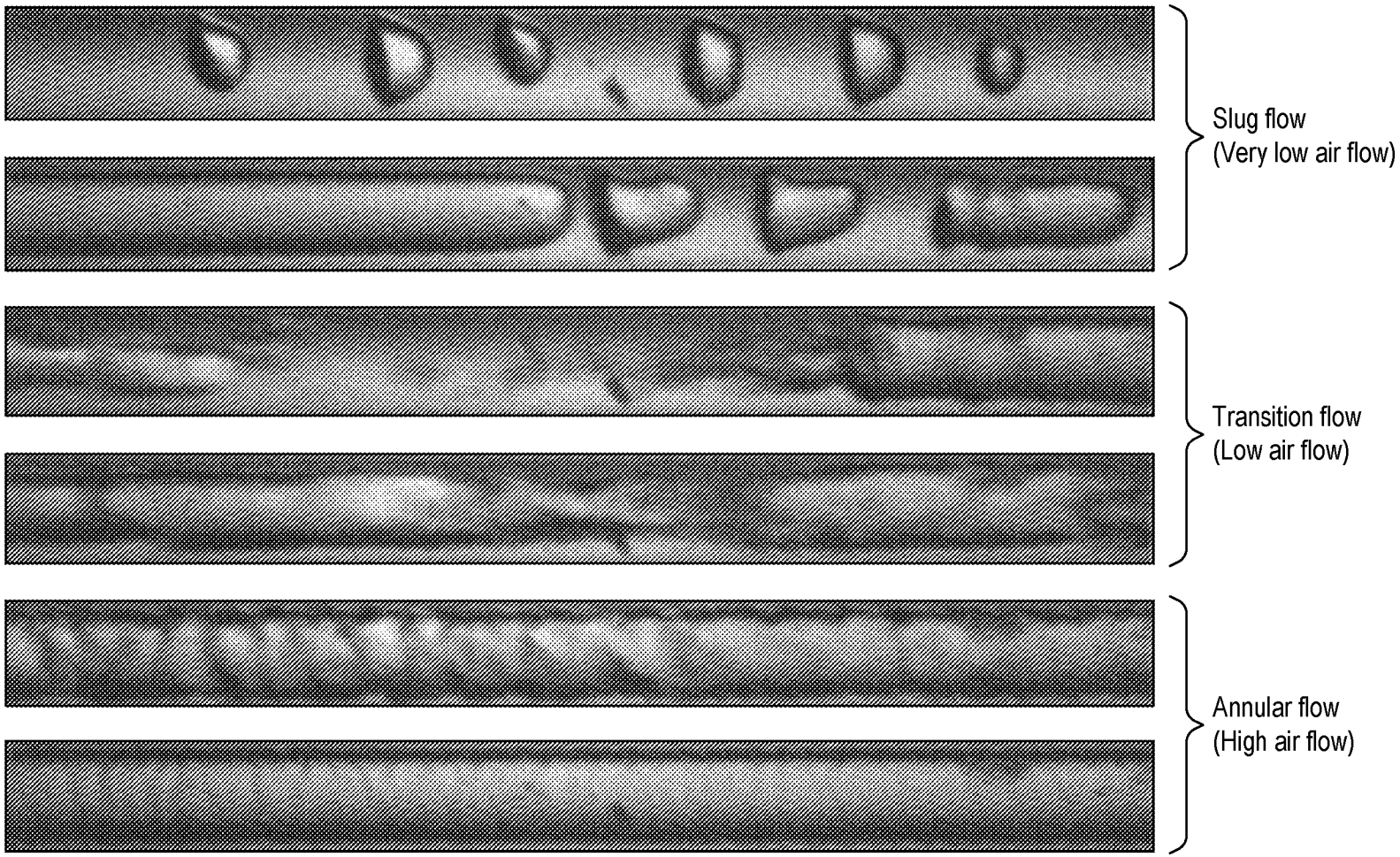
FIG. 2: shows the different flow regimes that might be observed in the gutter line of a continuous inkjet printer.

FIG. 2 shows the different flow regimes that can be found in the gutter line of a continuous inkjet printer. At high flow rates annular flow is observed. Annular flow is characterised by having ink flowing as an annulus down the gutter line and forming a layer on the inner surface of the line, whilst air flows down the centre of the line. At very low flow rates slug flow is observed. Slug flow is characterised by the ink moving slowly and forming into slugs pulled together by surface tension. In slug flow the ink and air are not mixed but form into, and flow as, individual slugs of ink and air. It is the experience of the present applicant that in single-jet continuous inkjet printers, the flow rates at which slug flow is observed are insufficient to clear all the ink as it collects in the gutter.

In between slug flow and annular flow is transition flow, which we interpret as the minimum flow rate that guarantees that all of the ink that enters the gutter line is removed by the pump without overflowing the gutter.

Figure 3:
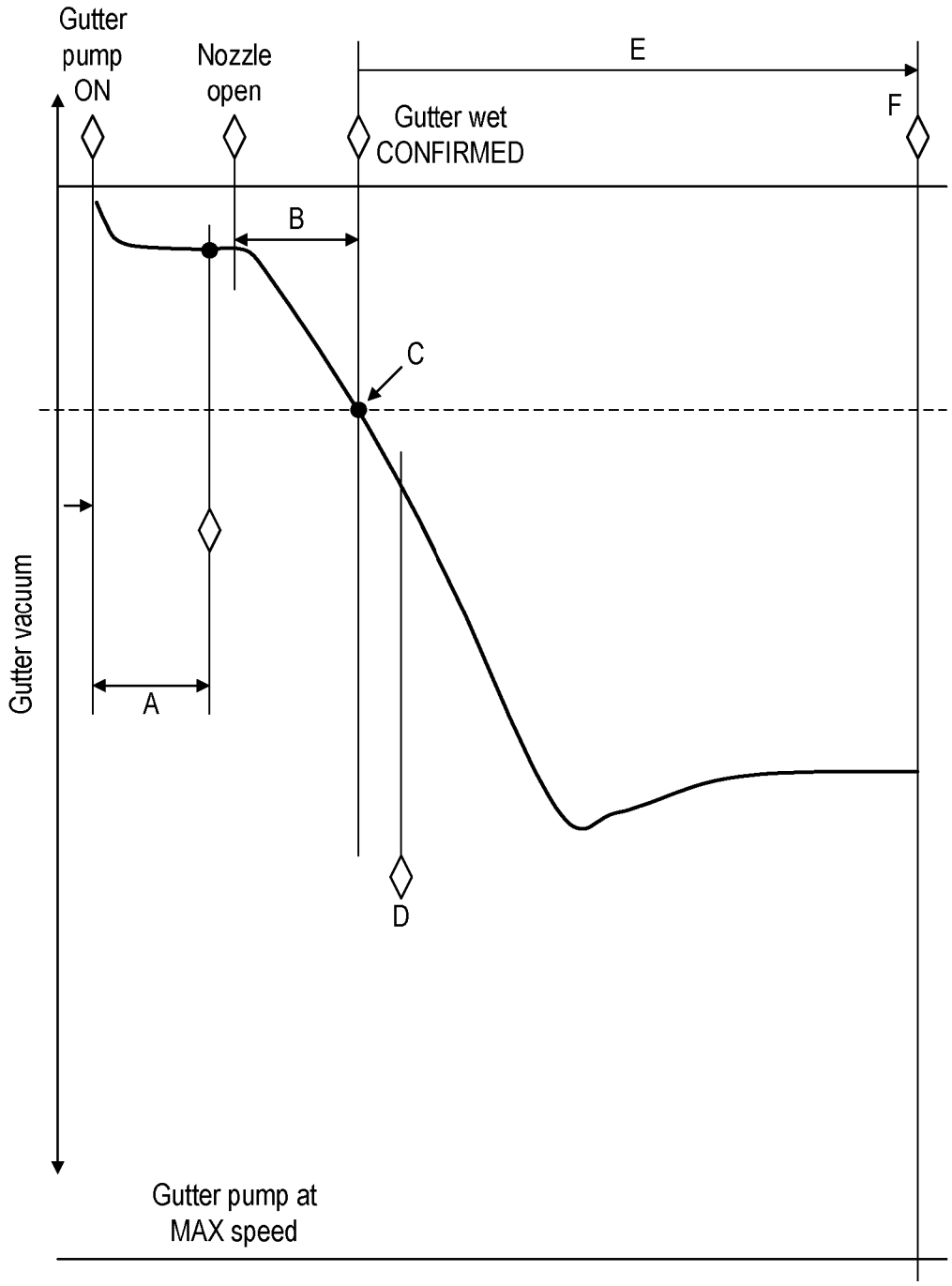
FIG. 3: shows plots of gutter line vacuum through the start-up process of a continuous inkjet printer.

FIG. 3 illustrates vacuum level during the start-up process. Upon start-up of the printer the gutter pump 24 is run and air is sucked down the gutter line. During the period marked A, a high airflow rate is chosen so that flow through the gutter line 23 begins in the annular region, just before the nozzle valve 21 is opened, the value of the gutter vacuum is stored in the operating system as being characteristic of the vacuum level for flowing air down the gutter. The nozzle valve 21 is then opened, ink is emitted from the nozzle 20, and that ink is then collected in the gutter 22. Initially the system has a low vacuum reading with low noise as air is sucked through the gutter line 23. When ink enters the line the vacuum will increase as the pump pulls against the ink, ink having a higher viscosity than air. During period B the printer tests to make sure that the vacuum has increased over the level recorded during period A above. With ink present, once annular flow is established, the noise level in the vacuum line is characterised at point C. Typically this is between 5 and 10 s after opening the nozzle by which time the vacuum should have reached a level at least 10% greater than during period A.

Figure 4:
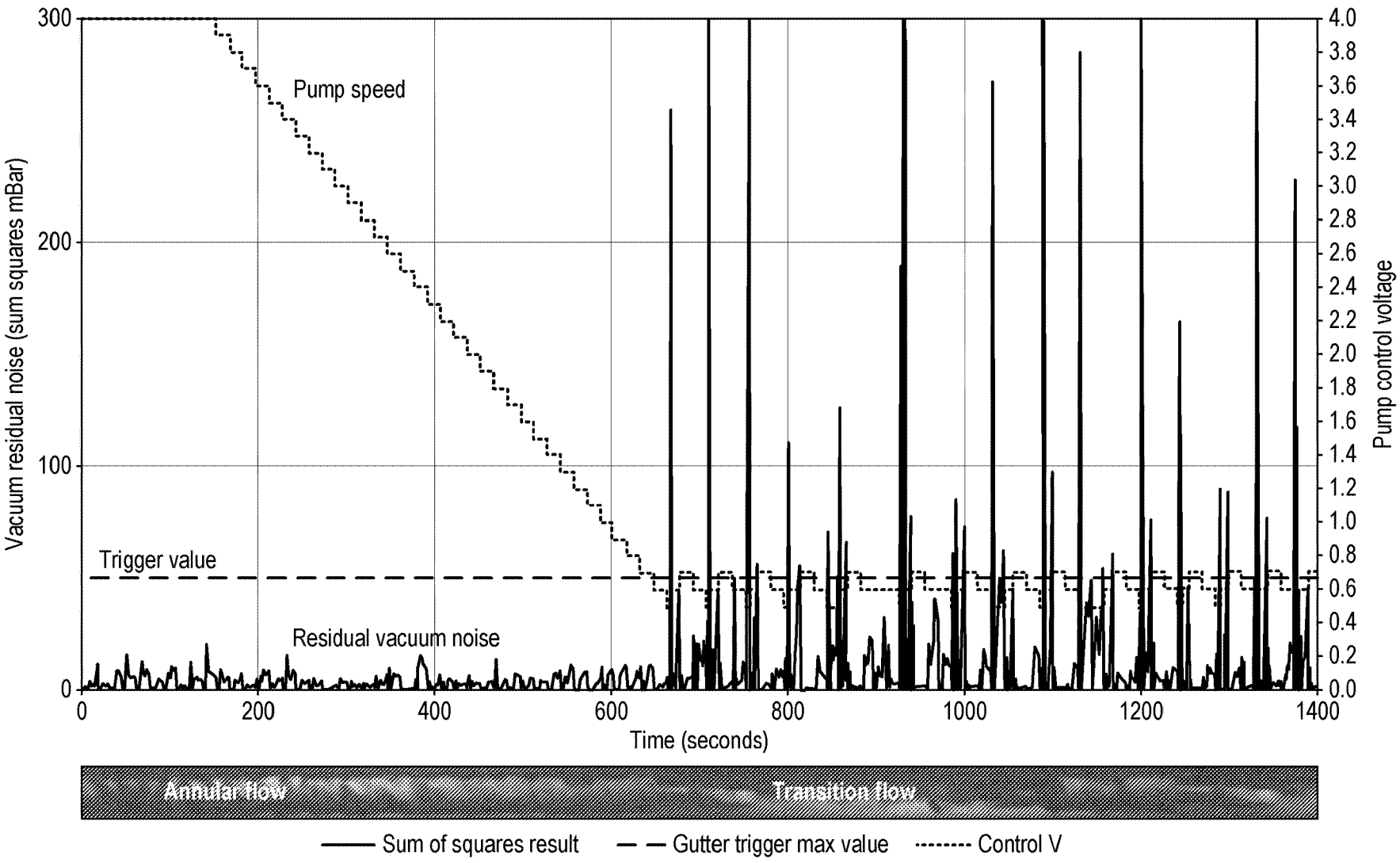
FIG. 4: shows plots of gutter line vacuum, gutter pump control voltage and gutter noise as a function of time.

FIG. 4 illustrates how the printer controls the vacuum pump during the start-up process. It should be noted that pump speed is governed by a 0-4V control input, which corresponds proportionately to the vacuum pump speed. FIG. 4 starts at the point marked D on FIG. 3. Between 0 and about 175 secs the pump is run at a high speed, designated by a pump control voltage of 4V, which is a period of time used to prime the gutter or, in other words, a period of time to establish a steady state ink flow and vacuum in the gutter. During this time, a large quantity of air flows down the centre of the gutter, whilst ink is pushed down the edges of the pipe, a flow type known as annular flow. The printer will determine a rolling average vacuum level during this time.

After the gutter has primed, the rolling noise level is characterised and used to control the gutter pump. In a typical implementation the vacuum sensor is sampled at a rate of about 2 kHz, and an average is calculated for every second's worth of data. A value for the vacuum noise is calculated for each sample by comparing each sample to the calculated average vacuum and determining the residual value (i.e. by finding the square of the difference and dividing by average vacuum,). The summation of the residuals for a second's worth of samples is assumed to be representative of the vacuum noise level during that second.

As can be seen in FIG. 4, the value of the residual vacuum noise is compared to a pre-determined threshold level or trigger value and if it is below the trigger value then the vacuum speed is lowered. This is carried out in steps. The trigger value is marked by the horizontal line on FIG. 4 at around 50 on the left hand or vertical scale. This value has been empirically determined over many systems to represent the onset of the transition point between annular flow and transition flow. Alternatively the printer can be put through a calibration regime to determine a transition value. In order to give the control system time to respond to each change in pump speed the printer collects the data for a total of 15 s before changing the pump speed again. The system discards the first three seconds of data as the effects of the pump changing speed compromise the measurements at this time. The next 12 s of worth of data are used and, in themselves, are averaged and compared to the trigger value. The graph of FIG. 4 between 175 secs and about 650 secs illustrates this algorithm well, showing the pump speed being stepped down approximately every 15 secs.

The last section of FIG. 4, between 650 secs and 1400 secs, shows the printer controlling the gutter pump at the transition point. It can readily be seen that the intuitive result, that gutter noise might gradually increase as pump speed lowers, is not the case. Instead there is an abrupt transition in noise level, which is significantly higher than the residual vacuum noise characterising annular flow. The pump speed is moved up and down in response to the residual value being above and below respectively the trigger value. In this way the gutter pump is controlled so that the minimum amount of air is drawn down the gutter in order to clear the gutter effectively.

The flow regime is a characteristic of the system and as mentioned earlier, we have determined a pressure amplitude control threshold, between annular and transition flow, that applies universally for a particular embodiment of printer. Any system tolerance or build-standard variance is automatically compensated for by the control system measuring the true transition from one flow phase to another. Factors affecting gutter flow and vacuum include gutter line internal diameter, gutter line length, ink viscosity (in gutter at ambient temperature), pump efficiency, pump speed, and nozzle diameter (ink flow rate).

By way of example, if we have a weak gutter pump, the system will compensate by driving the pump at a higher speed so as to maintain the pressure amplitude control. If the gutter line length is increased, say from a standard 3 m length to a 6 m length, the system will cause the gutter pump to be operated at a higher speed to maintain the control point.

When the printer system operates in different temperature environments a different pump speed will be required to clear the gutter, as the ink viscosity changes with temperature. As the operating position for the gutter line is based on the transition from annular flow to the transition flow region, which depends on viscosity, the system will find the right point to set the gutter pump so that the gutter is cleared independently of environmental condition.

Accordingly the system is able to find the point that guarantees reliable operation with minimum airflow down the gutter line. As airflow relates directly to solvent consumption, a printer operated according to the invention is therefore able to operate with much reduced solvent consumption.

In another aspect of the invention provides a method of detecting whether the nozzle 20 is correctly aligned with the gutter 22, and thus whether ink ejected from the nozzle has entered the gutter. The most likely scenario for the ink jet to miss the gutter, and soil the substrate, is upon start-up. As mentioned already, at start-up the printer establishes a base line vacuum level and vacuum noise level that characterises air flow through the gutter. Once the system is activated and ink ejected from the nozzle, it is expected that the vacuum level will rise. If this is not detected within a specified period, e.g. 7 seconds, then the printer can deduce that ink has not entered the gutter and shut down the jet, thus preventing further soiling of the substrate. Typically a 10% change is looked for.

In a normal operating mode, the printer will be running with an ink and air mixture passing through the gutter line. According to yet a further aspect of the invention, if the pressure sensor 25 detects a sudden fall in gutter vacuum level, it can deduce that only air is entering the gutter and, for some reason, the ink jet is no longer aligned with the gutter. The printer can therefore be configured to shut down the jet and prevent possible soiling of the substrate. Typically the printer achieves this by running a rolling average of the gutter vacuum level and comparing the currently measured vacuum to the rolling average established a short time before. In the preferred embodiment this is approximately 40 s before. The printer checks that the vacuum level has not fallen by more than 40%.

In still another aspect the invention provides a method of determining if the gutter line is blocked. According to this aspect if the pressure sensor 25 detects a rise in vacuum level then the printer can deduce that the gutter or gutter line is blocked. Typically the printer achieves this by running a rolling average of the gutter vacuum level and comparing the currently measured vacuum to the rolling average established a short time before. In the preferred embodiment this is again approximately 40 s before. The printer checks that the vacuum level has not risen by more than 80%.

In yet another aspect of the invention the printer system uses the measurement of a pump speed and compares this to a vacuum level at start-up to ascertain if the gutter pump is working as intended. If the expected level of vacuum is not observed within a period A as shown in FIG. 3 the printer deduces that the gutter pump is not operating as intended.

Another aspect of the invention concerns the efficient shut down of the printer. After closing off the jet at shut-down, the gutter line must be cleared to ensure that no ink remains in the gutter line which could dry and cause a blockage. The current practice with a continuous inkjet printer is to pump air, ink and solvent through the gutter line for a specified (and long) period of time to ensure the gutter line is cleared. This period of time must be set having regard to the worst-case scenario of the printer being operated at the bottom of its environmental specification and, as a result, shut-down can take a very long time to execute.

According to this aspect of the invention, instead of the printer system being configured to pump the air and ink mixture through the gutter line for a pre-determined period of time, the system is configured to operate the gutter pump while observing the vacuum level in the gutter line using sensor 25. Pumping is continued until the vacuum once again reaches the vacuum level corresponding to air, alone, passing through the gutter. At this point the pump is stopped and the shut-down is completed. A further period of time is run to ensure total clearance.

The invention claimed is:

1. A method of controlling the flow of ink and/or air through the gutter line of a single jet continuous inkjet printer using a vacuum pump, said method comprising:

identifying transition flow in said gutter line, where transition flow occurs between annular flow where ink flows as an annulus down the gutter line and forms a layer on the inner surface of the line, and slug flow, where ink and air are not mixed but form into, and flow as, individual slugs of ink and air in said gutter line by:

running the vacuum pump at a speed sufficient to establish annular flow of ink and air through the gutter line;

determining vacuum noise values in the gutter line;

comparing vacuum noise values with a predetermined threshold value; and lowering the speed of the vacuum pump until a vacuum noise value is greater than the predetermined threshold value; and controlling said vacuum pump to maintain transition flow in said gutter line by:

comparing vacuum noise values with a predetermined threshold value; and if a vacuum noise value is less than the predetermined threshold value, lowering the speed of the vacuum pump; or if a vacuum noise value is greater than the predetermined threshold value, raising the speed of the vacuum pump.

2. A continuous inkjet printer comprising a vacuum pump and a pressure sensor operable to measure vacuum values in a gutter line, and a controller operable to control the vacuum pump to carry out the method of claim 1.

3. A continuous inkjet printer comprising:

a gutter line;

a vacuum pump operative to draw ink and air through the gutter line;

a pressure sensor operable to measure vacuum values in the gutter line; and a controller operable to control the vacuum pump by:

identifying the transition between annular flow and transition flow in the gutter line by:

identifying transition flow in the gutter line, where transition flow occurs between annular flow, where ink flows as an annulus down the gutter line and forms a layer on the inner surface of the line, and slug flow, where ink and air are not mixed but form into, and flow as, individual slugs of ink and air in said gutter line by:

running the vacuum pump at a speed sufficient to establish annular flow of ink and air through the gutter line;

determining vacuum noise values in the gutter line;

comparing vacuum noise values with a predetermined threshold value; and lowering the speed of the vacuum pump until a vacuum noise value is greater than the predetermined threshold value; and controlling the vacuum pump to maintain transition flow in said gutter line by:

comparing vacuum noise values with a predetermined threshold value; and if a vacuum noise value is less than the predetermined threshold value, lowering the speed of the vacuum pump; or if a vacuum noise value is greater than the predetermined threshold value, raising the speed of the vacuum pump.

* * * * *